United States Patent [19]

Priebe

[11] Patent Number: 4,864,269

[45] Date of Patent: Sep. 5, 1989

[54] PORTABLE ELECTRICAL ADAPTER

[76] Inventor: Stanley R. Priebe, 7735 34th Avenue North West, Calgary, Albert, Canada, T3B 1P1

[21] Appl. No.: 160,308

[22] Filed: Feb. 25, 1988

[51] Int. Cl.[4] ..... H01H 61/01; H01H 71/08

[52] U.S. Cl. ..... 337/113; 337/380; 337/300; 200/61.06

[58] Field of Search ..... 337/113, 112, 3, 13, 337/300, 361, 381, 380; 200/61.06; 439/651, 652

[56] References Cited

U.S. PATENT DOCUMENTS

| | | | |
|---|---|---|---|
| 2,783,329 | 2/1957 | Jackson | 337/91 |
| 3,946,614 | 3/1976 | Martin | 337/361 |
| 4,163,965 | 8/1979 | Misinchuk | 439/652 |
| 4,538,134 | 8/1985 | Carey | 337/113 |

FOREIGN PATENT DOCUMENTS

| | | | |
|---|---|---|---|
| 1470924 | 4/1977 | United Kingdom | 200/61.06 |

*Primary Examiner*—H. Broome

*Attorney, Agent, or Firm*—Eugene J. A. Gierczak

[57] ABSTRACT

In a portable electrical adapter removably securable to an electrical wall receptacle for controlling electrical power, including; a housing adapted to house spaced first and second electrical conductors, said first electrical conductor presented at one end of said housing and including connecting structure for electrically conecting said first conductor to said electrical power of said wall receptacle, said second conductor presented at another end of said housing for supplying electrical power from said first conductor, and selectable condition sensing means presented by said housing electrically connected to said first and second conductor for sensing a selected condition in the vicinity of said condition sensing means and electrically connecting said first and second conductor so as to supply electrical power to said second conductor from the said wall receptacle when said variable condition sensing means senses said select condition, and to electrically disconnect said first conductor from said second conductor when said variable condition sensing means does not sense said condition.

10 Claims, 3 Drawing Sheets

PORTABLE ELECTRICAL ADAPTER

FIELD OF INVENTION

This invention relates to a portable electrical adapter removably securable to an electrical wall receptacle for controlling electrical power output therefrom, and particularly relates to a portable electrical adapter removably securable to an electrical wall receptacle in a room for controlling the temperature of said room.

BACKGROUND TO INVENTION

Various electrical adapters have heretofore been devised for a variety of reasons.

For example, U.S. Pat. No. 2,316,072 teaches connector plugs having an outlet or receptacle portion for receiving the contact lays of another connector plug.

Furthermore, U.S. Pat. No. 3,775,727 relates to an electrical adapter which converts a standard two hole receptacle for use with a three prong electrical plug having an equipment ground.

Moreover, U.S. Pat. No. 2,597,600 relates to a safety adapter incorporating a fuse for quick detachable use either in connection with an electrical appliance or an electrical outlet for plugging in either at a wall receptacle or at an analogous receptacle carried by the appliance.

Also U.S. Pat. No. 3,997,227 shows adapter fittings for electrical wall outlets, and more particularly to adapter fittings of the type capable of accommodating multiple three prong plugs wherein one of the prongs serves to provide a grounding circuit for the electrical appliance being used.

Finally, U.S. Pat. No. 3,938,068 relates to an electrical plug and outlet unit adapted to be plugged in a high voltage receptacle for converting the high voltage from the receptacle into a lower voltage at least one outlet forming a part of the unit.

Furthermore, various thermostat and humidistat devices have heretofore been devised for controlling the temperature or humidity in the vicinity of such device or within a room to be controlled by such device. However, such thermostats and humidistats are generally fixedly secured within the wall structure of a room or to the heating element controlled by the thermostat or the humidifier controlled by the humidistat.

It is an object of this invention to provide a simple portable electrical adapter which is capable of sensing a selected condition within the vicinity of the adapter.

It is a further object of this invention to provide an adapter which obviates the need to structurally change the wall of the room to accommodate a thermostat or humidistat in order to control the temperature or humidity in a particular room.

It is an aspect of the invention to provide a portable electrical adapter removably securable to an electrical wall receptacle, said adapter including a housing adapted to house spaced first and second electrical conductors, said first electrical conductor presented at one end of said housing and including connecting structure for electrically connecting said first conductor to said electrical power of said wall receptacle, said second conductor presented at another end of said housing for supplying electrical power from said first conductor; and selectable variable condition sensing structure selectably capable of being presented interiorally or exteriorally of said housing and electrically connected to said first and second conductor for sensing a selected condition in the vicinity of said condition sensing structure and electrically connecting said first and second conductor so as to supply electrical power to said second conductor from said wall receptacle when said variable conditions sensing structure senses said condition, and to electrically disconnect said first conductor from said second conductor when said selectable condition sensing structure does not sense said condition.

It is another aspect of this invention to provide a portable electrical adapter removably securable to an electrical wall receptacle in a room for controlling the temperature of said room by means of an electrical heater said adapter including an electrically insulated housing; electrical ground extending through said housing so as to present female ground elements at one end of said housing adapted to receive male ground electrical elements from said heater, said electrical ground extending through said housing to another end of said housing so as to present male ground elements exteriorally of said housing adapted for attachment to a ground of said wall receptacle; electrical neutral conductors extending through said housing so as to present female neutral elements at said one end of said housing adapted to receive male neutral elements from said heater, said electrical neutral conductors extending through said housing to said other end of said housing so as to present male neutral elements exteriorally of said housing adapted for attachment to a neutral conductor of said wall receptacle; a female hot element presented at said one end of said housing adapted to receive male hot elements from said heater, a male hot element spaced from said female hot element and extending through said housing exteriorally of said housing at said other end and adapted for attachment to a female hot element of said wall receptacle; a variable thermostat, selectably capable of being presented interiorally and exteriorally of said housing for selecting and controlling the temperature of said room wherein said thermostat electrically connects said female and male hot elements so as to supply electrical power to said electrical heater when said thermostat senses a temperature below said selected temperature of said room, and to disconnect said female and male hot elements when said thermostat senses a temperature above said selected temperature.

DESCRIPTION OF THE DRAWINGS

These and other objects and features shall now be described in reference to the following drawings.

DESCRIPTION OF THE INVENTION

Figure 1:
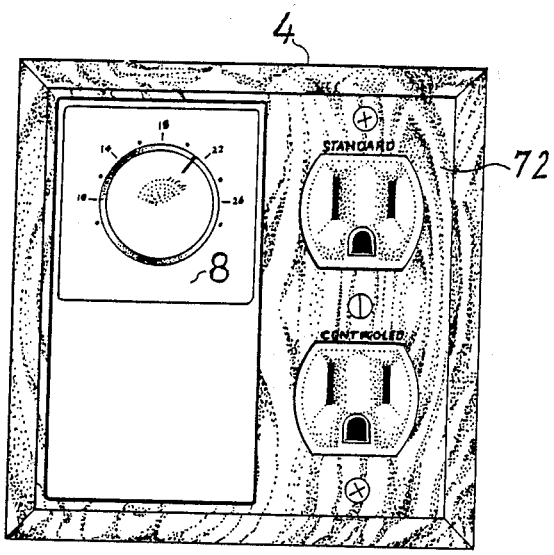
FIG. 1 is a front elevational view of said electrical adapter.

In the figures like numerals represent like elements.

The electrical adapter is generally depicted as numeral 2 throughout the figures.

The adapter 2 includes a housing 4 which contains adapter receptacle 6 and selectable condition sensing means which in the figures comprises a variable thermostat 8. However, it should be noted that such selected condition sensing means may comprise other devices such as a humidistat or the like.

The thermostat 8 includes two lead wires 10 and 12 for connection to said receptacle 6 in a manner to be more fully described herein. The thermostat 8 works in a manner well known to those persons skilled in the art and accordingly shall not be particularized herein.

Figure 6A:
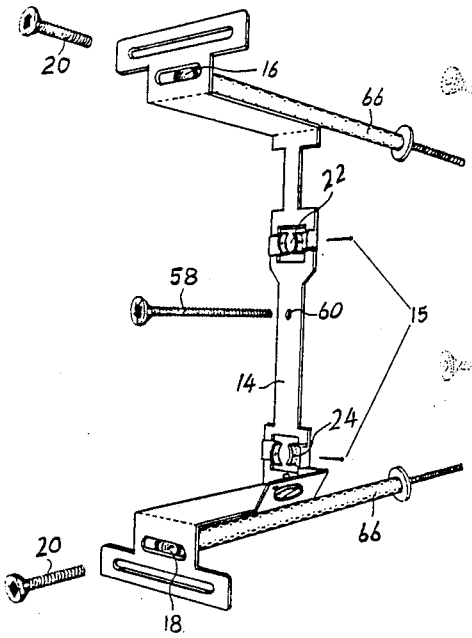
FIG. 6*a* is a perspective view particularly illustrating the mounting bracket.
Figure 6B:
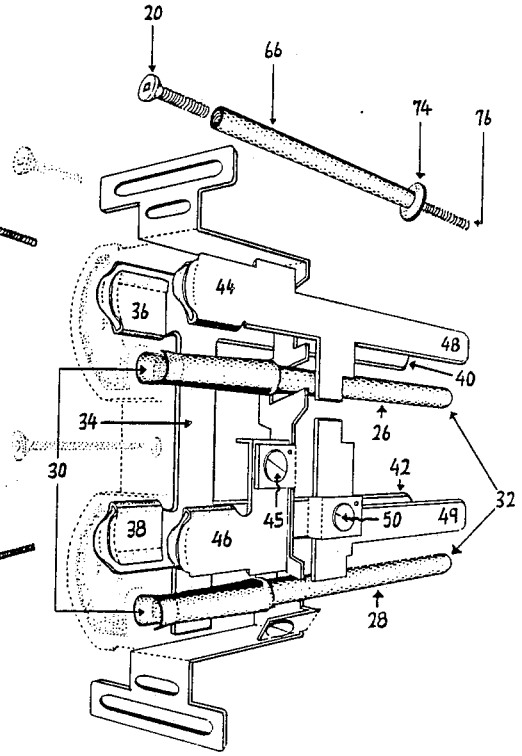
FIG. 6*b* is an exploded partial perspective view of said adaptor receptacle.
Figure 5:
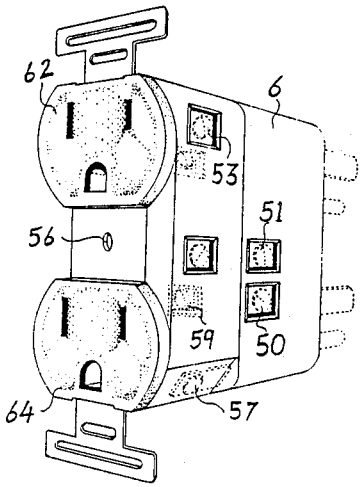
FIG. 5 is a perspective view of the adapter receptacle.
Figure 7:
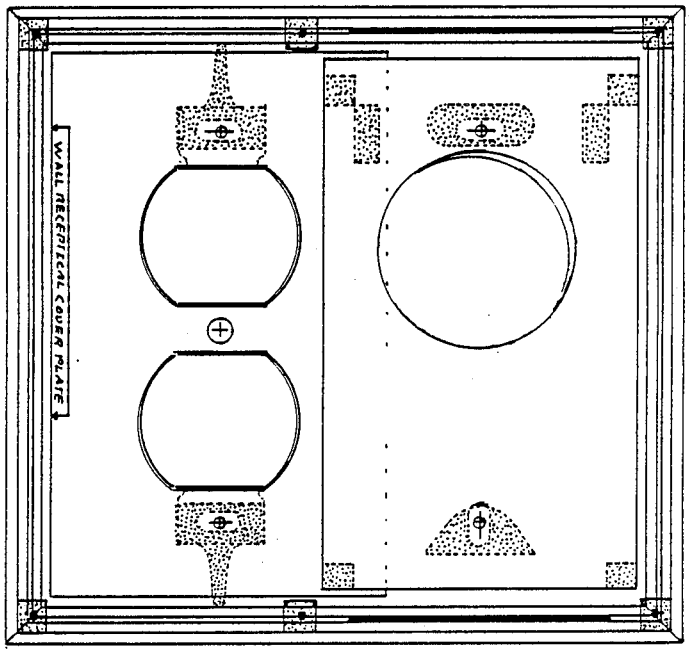
FIG. 7 is a rear perspective view of said housing.

The receptacle 6 is best illustrated in FIGS. 5 and 6. The receptacle 6 comprises of an insulating material such as plastic or the like.

Receptacle 6 includes a grounded mounting bracket 14 fixedly secured to the exterior top back and middle portions of the receptacle 6. Mounting bracket 14 includes apertures 16 and 18 adapted to receive screws 20.

Mounting bracket 14 includes two openings 22 and 24 adapted to receive electrical ground conductors 26 and 28 respectively. Ground 26 and 28 are fixedly secured to the mounting bracket 14 by means of pins or rivets 15. Each electrical ground conductor 26 and 28 includes a female ground element 30 presented at one end namely the front end of the receptacle 6 and housing 14 adapted to receive the male ground electrical element (not shown) of an appliance (not shown) such as an electrical heater, air conditioner or the like.

Figure 2:
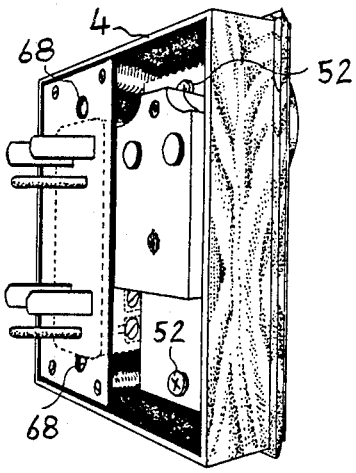
FIG. 2 is a rear perspective view of said adapter.
Figure 3:
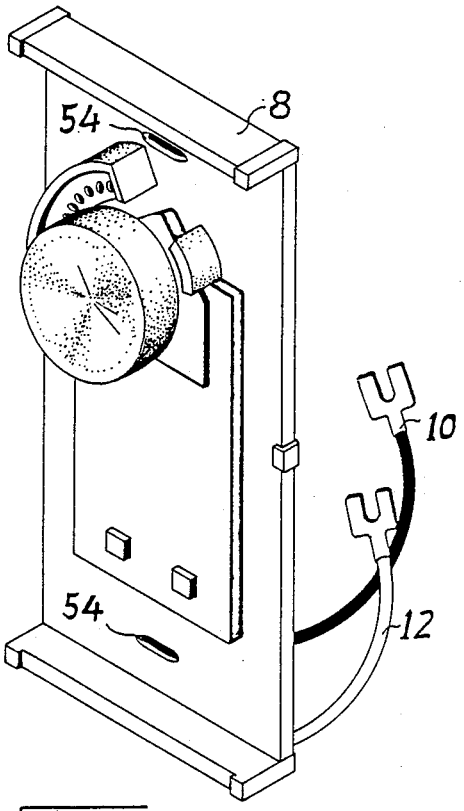
FIG. 3 is a perspective view of a thermostat.

Electrical ground elements 26 and 28 each extend through the receptacle 6 and housing 4 so as to present male ground electrical elements 32 which extend through the receptacle 6 and housing 4 as best illustrated in FIGS. 2 and 5 for attachment to female ground portions of a wall receptacle (not shown).

Receptacle 6 also includes an electrical neutral conducting conduit or element 34. The electrical neutral conducting conductor 34 extends through the receptacle 6 and housing 4 so as to present first and second female neutral elements 36 and 38 respectively at the front end of the receptacle 6 and housing 4 adapted to receive male neutral elements from an electrical plug of an appliance (not shown).

The electrical neutral conductor 34 extends through the receptacle 6 and housing 4 so as to present male neutral elements 40 and 42 extending through receptacle 6 and housing 4 exteriorally thereof and adapted for attachment to female neutral elements of a wall receptacle (not shown).

The receptacle 6 also includes first and second female electrically hot elements or conductors 44 and 46 respectively presented in the front end of the receptacle 6 and housing 4 which are adapted to receive male electrically hot elements from an appliance (not shown) such as an electrical heater. The first female electrical hot element 44 is electrically joined to first male electrical hot element 48. A second male electrically hot element or conductor 49 is spaced from the second female electrically hot element 46 and extends through receptacle 6 and housing 4 to the back end thereof exteriorally of the receptacle 6 and housing 4.

The male electrically hot element extends through the receptacle 6 and housing 4 exteriorally to the back end thereof and adapted for attachment to a female hot element of a wall receptacle (not shown).

Female electrically hot element 46 presents a connecting screw 45 which protrudes through the receptacle 6. Male electrically hot element 49 also includes a screw 50 which protrudes through the receptacle 6.

Screws 45 and 50 are adapted for connection to the wires 10 and 12 of thermostat 8.

The thermostat 8 is adapted for connection to the housing 4 by means of screws 52 adapted to be received by holes 54 of thermostat 8. The two screws 52 are then fixedly removably secured into appropriate threaded holes (not shown) located in housing 4.

Furthermore, receptacle 6 includes apertures 56 which are adapted to receive receptacle mounting screw 58. The mounting screw 58 is received by threaded hole 60 located in mounting bracket 14 and adapted to be fastened thereto.

Receptacle 6 is fastened to housing 4 by suitable fastening means such as screws or the like.

The operation of the adapter 2 shall now be described. The electrical adapter 6 may be plugged into a standard two hole wall receptacle by inserting the male elements 32, 40, 42, 48 and 49 into the wall receptacle (not shown). The thermostat 8 would then be manipulated to a desired selected temperature for controlling the temperature of a room.

An electrical heater (not shown) may then be electrically connected to the female elements 38, and 46. Once the temperature of the room falls below the selected temperature, thermostat 8 would sense same and connect hot elements or conductors 46 and 49 so as to supply electrical energy or power from the wall receptacle to the electrical heater so as to raise the temperature of the room. Once the temperature of the room rises above the selected temperature, the thermostat 8 would sense same and disconnect conductors or elements 46 and 49.

In the embodiment illustrated in FIG. 6 female element 44 is connected to male element 49 so as to present a first receptacle face 62 which is not controlled by the thermostat 8 while the power supply from the second receptacle face 64 is controlled by the thermostat 8 as described above.

Figure 4:
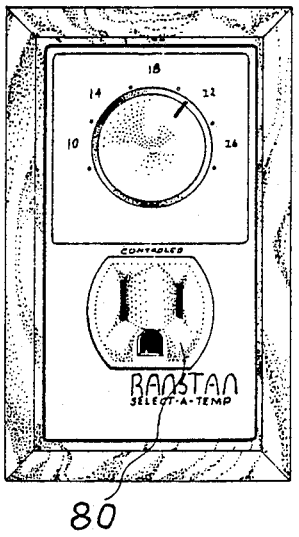
FIG. 4 is a front elevational view of a second embodiment of the invention.

FIG. 4 illustrates a second embodiment of the invention wherein only one receptacle face 80 is included which is controlled by thermostat 8.

Adapter 2 is also provided with a pair of elongated mounting screw assembly 66 adapted to semipermanently mount the adapted 2 to threaded holes located behind the cover plate of a wall receptacle (not shown). Accordingly, in order to semipermanently mount housing 4 to a electrical wall receptacle the cover plate of the wall receptacle is removed to expose the threaded holes (not shown) which are adapted to receive and releasably secure the elongated mounting screw assembly 66. Thereafter adapter 2 is placed over the wall receptacle such that assembly 66 are received through holes 68 of back cover plate 70. Finally, front cover plate 72 is placed over receptacle 6 and screws 20 are secured to assembly 66. Screw 58 is adapted to be threadedly received by hole 60 to secure receptacle 6 to housing 4.

Although adapter 2 may be semipermanently secured to electrical wall receptacle (not shown) as described, such unit or adapter 2 is still portable by means of removing mounting screw assembly 66. The mounting screw assembly 66 include washer 74 and threaded portion 76. For greater particularity mounting screw assembly 66 is optional depending on whether the user desires to threadedly secure housing 4 to the wall receptacle or not.

Accordingly the invention as described illustrates the adapter which may be easily mounted to an existing standard three inch by two inch outlet box of a wall receptacle by simply removing the cover plate of a wall receptacle.

Furthermore the receptacle 6 may be removed from the housing 4 and the thermostat 8 may also be removed whereby the receptacle may be electrically connected to a wall receptacle box by connecting the ground wire in the wall receptacle to ground screw 57, neutral wire of wall receptacle to neutral screw 59 and hot wire of wall receptacle to hot screw 51. An appropriate insulated cap (not shown) would be attached to the male elements 48, 49, 40, 42 and male grounds 26 to prevent any short circuits. The thermostat 8 may then be attached to a receptacle in another location with the wires 10 and 12 of thermostat 8 electrically connected to screws 45 and 50. A jumper wire may be used to connect screw 51 and 53 so as to energize face 62; or in another alternative embodiment a jumper wire may be connected to screw 45 and screw 53 such that face 62 would be controlled by thermostat 8 in a manner as described herein.

The adapter 2 described herein is adapted to work in harmony with a type 1A65 electrical heat thermostat single pole unit switch action open on rise.

The adapter 2 described herein may be used in such places as a room, in a home or cottage, in a motor home, trailer, camper, tent or any place that includes a 120 volt alternating current. The thermostat 8 described herein is adjustable from 4 degrees centigrade to 29 degrees centigrade and therefore may be used in combination with a block heater located in an automobile, tractor, or other vehicle. When the adapter or unit 2 is activated, such adapter stays on until the desired temperature is reached.

Although the preferred embodiment as well as the operation and use have been specifically described in relation to the drawings it should be understood that variations in the preferred embodiment could easily be achieved by a skilled man in the trade without departing from the spirit of the invention. Accordingly the invention should not be understood to be limited to the exact form or field by the drawings.

The embodiments of the invention in which an exclusive property or privilege is claimed are defined as follows:

1. A portable electrical adapter removably securable to an electrical wall receptacle, including: a housing adapted to house spaced first and second electrical conductor means, said first electrical conductor means presented at one end of said housing and including connecting means for electrically connecting said first conductor means to said electrical power of said wall receptacle, said second conductor means spaced from said first conductor means interiorally of said housing and extends to another end of said housing and variable condition sensing means selectably removable from said housing for electrical connection to said first and second conductor means for sensing a selected condition in the vicinity of said condition sensing means and electrically connecting said first and second conducting means so as to supply electrical power to said second conductor means at said other end of said housing from said wall receptacle when said variable condition sensing means senses said condition and to electrically disconnect said first conductor means from said second conductor means when said variable conditions sensing means does not sense said condition.

2. An adapter as claimed in claim 1 wherein said variable condition sensing means comprises a humidistat for selecting the humidity in the region of said housing at which said humidistat electrically connects said first and second conductor means so as to supply said electrical power to said second conductor means and to electrically disconnect said first conductor means from said second conductor means when said humidistat does not sense said electrical humidity in the vicinity of said housing.

3. An adapter as claimed in claim 1 wherein said variable condition sensing means comprises a variable thermostat for selecting the temperature at which said thermostat electrically connects said first and second conductor means so as to supply said electrical power to said second conductor means and to electrically disconnect said first conductor means from said second conductor means when said thermostat does not sense said selected temperature in the vicinity of said housing.

4. An adapter as claimed in claim 3 wherein said second conductor means includes female elements adapted to electrically receive an electrical heater and wherein said thermostat connects said first and second conductor means and supplies electrical power to said heater when said thermostat senses a temperature in the vicinity of said thermostat below said selected temperature and wherein said thermostat disconnects said first conductor means from said second conductor means when said thermostat senses a temperature above said selected temperature.

5. An adapter as claimed in claim 4 wherein first and second electrical conductor means each include spaced first and second electrical hot conducting elements respectively and first and second electrical neutral elements respectively, wherein said first electrically neutral element is permanently connected to said second electrically neutral element and said thermostat means is electrically connected to said first and second electrically hot elements.

6. A portable electrical adapter removably securable to an electrical wall receptacle in a room for controlling the temperature of said room, including:

(a) an adapter receptacle including (i) electrical ground means extending through said adapter receptacle so as to present female ground element means at one end of said adapter receptacle adapted to receive electrical male ground elements from an electrical heating means, said electrical ground means extending through said adapter receptacle to another end of said adapter receptacle so as to present male ground electrical element means adapted for attachment to a ground of said wall receptacle;

(ii) electrical neutral conducting means extending through said adapter receptacle so as to present female neutral element means at said one end of said adapter receptacle adapted to receive male neutral elements from said electrical heating means, said neutral conducting means extending through said adapter receptacle so as to present male neutral element means extending exteriorally from said other end of said adapter receptacle for attachment to a neutral conductor of said wall receptacle;

(iii) female hot element means disposed at said one end of said adapter receptacle for receiving male hot elements from said electrical heating means, said female hot element means extending interiorally into said adapter receptacle, and male hot element means disposed interiorally of said adapter receptacle and extending through said adapter receptacle for attachment to female hot elements of said wall receptacle said male hot element means spaced from said female hot element means interiorally of said adapter receptacle;

(b) variable thermostat means for selecting and controlling the temperature of said room wherein said thermostat is electrically connected to said spaced female and male hot elements so as to electrically connect said spaced female and male hot element means and supply electrical power to said electrical heating means when said thermostat senses a temperature below said selected temperature of said room, and to disconnect said female and male hot element means when said thermostat senses a temperature above said selected temperature.

(c) electrically insulated housing means for housing said adapter receptacle and said variable thermostat means.

7. A portable adapter as claimed in claim 6 wherein said female hot element means and said male hot elements means each present screw means extending exteriorally through said receptacle means and adapted to be electrically connected to said thermostat means.

8. A portable adapter as claimed in claim 7 wherein said housing means presents one set of female hot, neutral and ground element means which are controlled by said variable thermostat means.

9. A portable adapter as claimed in claim 7 wherein said housing means presents two sets of female hot, neutral and ground element means wherein only one set of female hot, neutral and ground element means are controlled by said variable thermostat means.

10. A portable electrical adapter as claimed in claim 6 wherein said variable thermostat means is removable from said housing so as to remove said variable thermostat means to a separate location with said variable thermostat means electrically connected to said spaced female and male hot element means.

* * * * *